US007455468B2

(12) United States Patent
Gueret

(10) Patent No.: US 7,455,468 B2
(45) Date of Patent: Nov. 25, 2008

(54) PACKAGING AND APPLICATION DEVICE WITH ADJUSTABLE WIPING

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 126 days.

(21) Appl. No.: 11/611,617

(22) Filed: Dec. 15, 2006

(65) Prior Publication Data

US 2007/0141862 A1 Jun. 21, 2007

Related U.S. Application Data

(60) Provisional application No. 60/755,099, filed on Jan. 3, 2006.

(30) Foreign Application Priority Data

Dec. 15, 2005 (FR) ..... 05 53900

(51) Int. Cl.
*A46B 11/00* (2006.01)

(52) U.S. Cl. ..... 401/126; 401/122

(58) Field of Classification Search ..... 401/122, 401/126–130; 132/317
See application file for complete search history.

(56) References Cited

U.S. PATENT DOCUMENTS

| | | | | |
|---|---|---|---|---|
| 4,194,848 A | | 3/1980 | Kingsford | |
| 4,261,376 A | | 4/1981 | Kingsford | |
| 4,407,311 A | * | 10/1983 | Gueret | 401/122 |
| 4,433,928 A | | 2/1984 | Kingsford | |
| 4,609,300 A | * | 9/1986 | Robert | 401/122 |
| 4,627,454 A | | 12/1986 | Dahm | |
| 4,705,053 A | * | 11/1987 | Goncalves | 132/218 |
| 5,597,254 A | | 1/1997 | Vasas | |
| 6,328,495 B1 | | 12/2001 | Gueret | |
| 6,676,320 B1 | * | 1/2004 | Wainer | 401/122 |

FOREIGN PATENT DOCUMENTS

| | | |
|---|---|---|
| EP | 0 002 301 | 6/1979 |
| EP | 1 046 358 | 10/2000 |
| FR | 2 605 198 | 4/1988 |
| WO | WO 94/14357 | 7/1994 |

OTHER PUBLICATIONS

U.S. Appl. No. 11/611,684, filed Dec. 15, 2006, Gueret.

* cited by examiner

*Primary Examiner*—David J Walczak
(74) *Attorney, Agent, or Firm*—Oblon, Spivak, McClelland, Maier & Neustadt, P.C.

(57) ABSTRACT

The device includes a container and an applicator including a rod connected at a first end to a gripping member and to an application element at a second end. The device further includes a first wiping member disposed in the container and including a deformable portion configured to wipe the application element during extraction of the application element from the container. The device includes a movable adjustment member that limits deformation of the deformable portion during passage of the application element through the deformable portion. Deformation of the deformable portion is less limited by the adjustment member when the adjustment member is in a second position than when the adjustment member is in a first position. The adjustment member typically limits deformation of the deformable portion without substantially constraining the deformable portion when the deformable portion is un-deformed by either the application element or rod, irrespective of a position of the adjustment member.

40 Claims, 5 Drawing Sheets

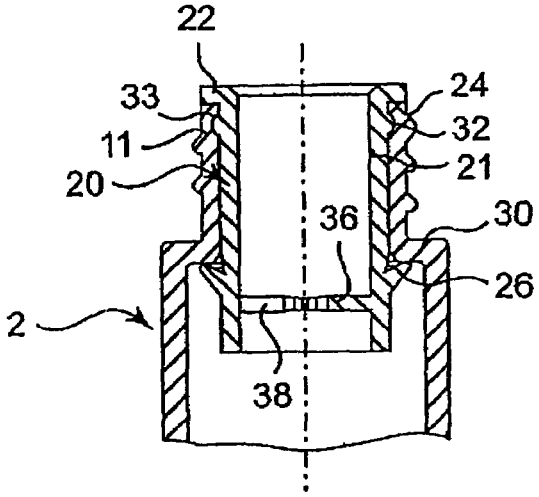
Fig.4
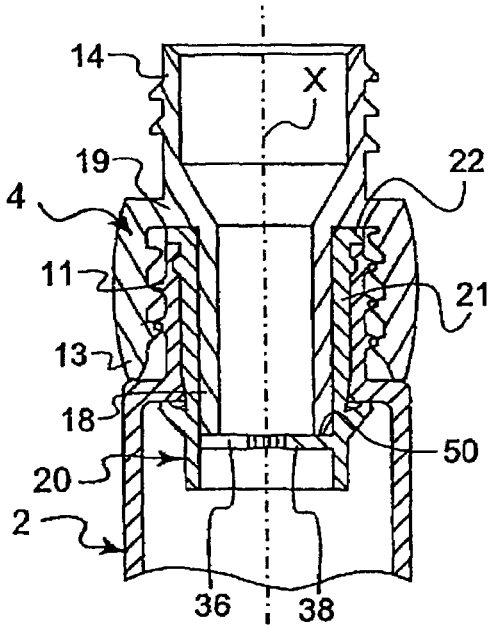
Fig.5
Fig.6
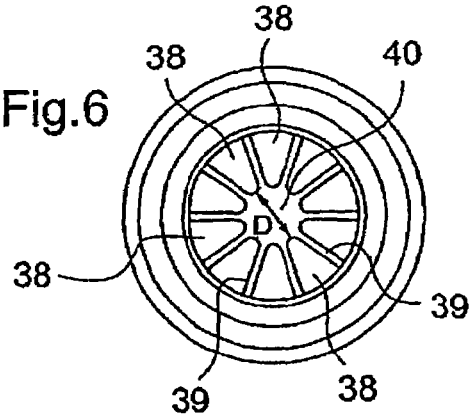
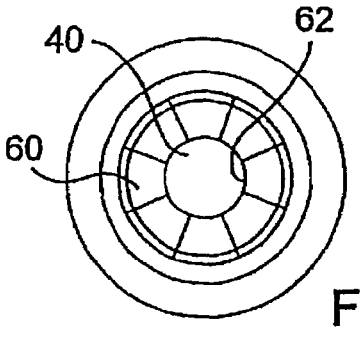
Fig.10
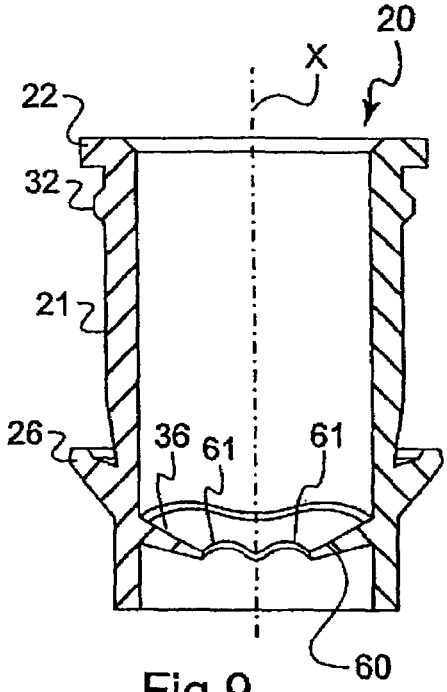
Fig.9

PACKAGING AND APPLICATION DEVICE WITH ADJUSTABLE WIPING

CROSS-REFERENCE TO RELATED APPLICATIONS

This document claims priority to French Application Number 05 53900, filed Dec. 15, 2005, and U.S. Provisional Application No. 60/755,099, filed Jan. 3, 2006, the entire content of each of which are hereby incorporated by reference herein.

FIELD OF THE INVENTION

The present invention relates to packaging and application devices comprising a container containing the product to be applied and an applicator comprising a rod provided at an end with an application element. One example of the invention provides a device in which the application element is a brush or a comb for applying a make-up and/or care product on keratinous fibres, for example, the eyelashes and/or eyebrows.

BACKGROUND OF THE INVENTION

Discussion of Background

EP 0 002 301 describes a device in which a container comprises a wiping member and an adjustment means making it possible to act on the size of the opening in the wiping member through which the application element passes.

In certain embodiments, the wiping member is deformed to a greater or lesser extent according to the size of the opening sought for the wiping. As the wiping member is made from an elastically deformable material, it risks losing elasticity by being kept under constraint during storage.

EP 0 002 301 also describes embodiments in which the adjustment means comprise a non-centered and/or non-circular opening, so that, by turning the adjustment means, the passage area provided for the application element can be modified.

One advantage is that the wiping member can be un-constrained irrespective of the position of the adjustment means. One drawback is that the passage area is not circular, which can lead to non-uniform wiping of the application element.

FR 2 605 198 describes a device in which an adjustment ring turning on the container can constrain the wiping member, or not, according to the degree of wiping sought. There is the risk, as for certain devices described in EP 0 002 301, of a reduction in performance of the wiping member in the event of prolonged storage under constraint.

EP 1 046 358 describes a device comprising a wiping member adapted to the wiping of a flat rod, with no means of adjusting the wiping. A device comprising two wiping members, one of which is removable, is also available.

A need exists for a packaging and application device with means of adjusting the wiping and making it possible to preserve the performance of the wiping member in the long term. One example of the invention at least partially satisfies this need.

SUMMARY OF THE INVENTION

One example of the invention provides a device for packaging and application of a cosmetic. The device includes a container containing a product and an applicator including a rod connected at a first end to a gripping member and connected at a second end, opposite the first end, to an application element. The device further includes a first wiping member disposed in the container and including a deformable portion configured to wipe the application element during extraction of the application element from the container.

This example of the invention also provides an adjustment member, movable in relation to a first wiping member between at least first and second positions and arranged proximate to a deformable portion of the first wiping member. The adjustment member is arranged such that, in the first position, deformation of the deformable portion is limited by the adjustment member during passage of the application element through the deformable portion. When the adjustment member is in the second position, deformation of the deformable portion is less limited by the adjustment member than when the adjustment member is in the first position. Additionally, the adjustment member limits deformation of the deformable portion without substantially constraining the deformable portion when the deformable portion is un-deformed by either the application element or rod, irrespective of a position of the adjustment member.

Another example of the invention includes a packaging and application device with a container containing the product to be applied. This example includes an applicator comprising a rod connected at a first end to a gripping member and at a second end, opposite to the first, to an application element. This example further includes a wiping member disposed in the container and comprising a deformable portion for wiping the application element when the latter is extracted from the container. Additionally, this example typically includes an adjustment member configured to move in relation to the wiping member. The adjustment member can limit deformation of the deformable portion of the wiping member without ever substantially constraining the deformable portion of the wiping member at rest, irrespective of the position of the adjustment member. In this example, the adjustment member can take up at least a first position in which deformation of the deformable portion is limited by the adjustment member during the passage of the application element through the deformable portion. The adjustment member can take up at least a second position in which deformation of the deformable portion is not limited, or is less limited than when the adjustment member is in the first position.

Another example of the invention includes a device for packaging and application of a cosmetic. The device includes a container containing a product and an applicator including a rod connected at a first end to a gripping member and connected at a second end, opposite the first end, to an application element. This example further includes a wiping member disposed in the container and including a deformable portion configured to wipe the application element during extraction of the application element from the container. The above-noted example further includes means for adjusting amounts of deformation of the deformable portion. The means for adjusting is movable in relation to the wiping member between at least first and second positions. The means for adjusting is arranged proximate to the deformable portion of the wiping member in the first position such that deformation of the deformable portion is limited by the means for adjusting during passage of the application element through the deformable portion. Further, when the means for adjusting is in the second position, deformation of the deformable portion is less limited by the means for adjusting than when the means for adjusting is in the first position. In this example, the means for adjusting limits deformation of the deformable portion without substantially constraining the deformable portion when the deformable portion is un-deformed by either the application element or rod, irrespective of a position of the means for adjusting.

The invention typically facilitates implementation of a device providing at least two degrees of wiping of the application element, for example, strong wiping and weak wiping, or medium wiping and strong or weak wiping.

In one embodiment, the wiping member can be arranged to spread without stretching circumferentially.

In one example of the invention, the adjustment member comprises a limiting element configured to be positioned in proximity to or in contact with the deformable portion, so as to limit the deformation thereof upon passage through it of the application element. This limiting element typically includes, for example, a tubular shape so as to be passed through by the rod and the application element. The limiting element can have a circular cross-section, but other shapes are also possible. The limiting element can be arranged to wipe the rod and/or the application element.

The adjustment member can have a cross-section (i.e., opening or hole) provided for passage of the application element larger than defined by the wiping member. In particular the cross-section can have an internal diameter larger than that of the wiping member. Alternatively, the cross-section provided for passage of the application element can be smaller than an opening defined by the wiping member. For example, when the cross-section is circular, it can have an internal diameter smaller than an internal diameter of the wiping member.

In an example, the application element is arranged to deform the deformable portion of the wiping member during its passage through the wiping member. Further the deformable portion can be arranged to spread without stretching. The deformable portion can define a passage area for the application element with a diameter smaller than that of the rod, apart from a possible throat in the rod that has a diameter smaller than a remainder of the rod.

In another example, the adjustment member can comprise a wiping lip, which is, for example, made in a single piece with the rest of the adjustment member. This wiping lip can have a circular free edge, but other shapes are possible.

By way of example, the adjustment member can be configured to be fixed in a removable manner on the container. The adjustment member can also be configured to be fixed in a removable manner on the gripping member, which can make it possible to fix the applicator on the container by means of the adjustment member. The adjustment member can be shaped or decorated to contribute towards the aesthetic quality of the device, for example by being made with a color different from that of the gripping member or of the container. Further, the adjustment member can comprise an internally threaded mounting skirt, arranged to be screwed onto the container, and an externally threaded neck, onto which the gripping member can be screwed.

The rod can have a throat located adjacent to the deformable portion, when the applicator is in place on the adjustment member and the latter is fixed on the container.

The adjustment member can also, according to another example of the invention, be fixed or coupled permanently on the container while being, for example, movable axially and rotationally in relation to the container. In other words, this embodiment of the adjustment member is not configured to be completely removed from the container.

One example of the device includes a wiping ring surmounting the adjustment member. The wiping ring can define internally a channel with a diameter smaller than or equal to that of the deformable portion.

At least one of the container and the adjustment member can comprise a guide track. If the container includes the guide track, then the adjustment member will typically include a raised part cooperating with this guide track so as to convert a rotational movement of the adjustment member into an axial movement thereof in relation to the wiping member. Alternatively, the container can include the raised part and the adjustment member can include the guide track.

The guide track can comprise, for example, a groove or slot made on the adjustment member and the raised part can be a pin or a portion of thread engaged in this groove or slot. In one example, the adjustment member comprises a slot and the container comprises a pin engaged in this slot. The pin can be visible from the outside, so as to serve as an adjustment indicator.

The deformable portion can extend substantially perpendicular to the axis of the rod at rest, or upwards or downwards relative to the axis of the rod in variants. The deformable portion of the wiping member can be implemented so as to be able to deform relatively easily, for example to spread without stretching. For example, the deformable portion of the wiping member can thus include, at least one slot, which can facilitate deformation of the deformable portion upon passage of the application element. The deformable portion can include one or more fins. The deformable portion can also comprise a corrugated lip.

The presence of at least one slot, fins or a corrugated lip can facilitate wiping a wide variety of application members, in particular application members having a cross-section relatively large compared with the cross-section of the rod and/or which are relatively fragile. For example, some application members include hairs or flocking.

The deformable portion of the wiping member can include at least one wiping lip with a radially internal free edge defining an opening for passage of the application element. The length of the perimeter of the free edge is typically greater than that of the opening observed in top projection. For example, by virtue of the presence of corrugations, the length of the perimeter of the free edge can be equal to the length of a perimeter of a larger opening without corrugations. The perimeter of the free edge is, in one example, greater in size than that of the rod intended to be wiped. The presence of corrugations allows the wiping lip to deform more easily upon passage of the application element when the latter is inserted into the container and/or extracted therefrom. The corrugations facilitate wiping the application element, and can reduce any piston (suction) effect created while wiping the rod.

The wiping member can typically adapt, by virtue of the presence of at least one slot, fins or a corrugated lip, to an application element having a relatively large variation in its cross-section, while wiping the rod supporting this application element.

In one example, the wiping member can include, at rest, an internal diameter close to that of the rod. In this example, when the application element is introduced through the wiping member, the corrugations of the wiping lip facilitate, by spreading, widening of the opening defined by the wiping lip in order to allow the application element to pass. One benefit of this arrangement is that excessive pressure liable to damage the wiping lip or application element is reduced. Accordingly, the wiping can remain gentle in the example discussed above, whereas a conventional wiping lip tends to become stiff upon widening.

"Corrugations" should be understood to mean a series of depressions and/or protrusions formed by the wiping lip, moving in the circumferential direction. They can be bends or folds that are alternately concave and convex in the circumferential direction. Each corrugation of the wiping lip can extend, when the wiping lip is observed from above, along a radially oriented axis. All the axes of the corrugations can intersect substantially at the center of the opening defined by the wiping lip. The axes of the corrugations can be oriented substantially perpendicular to the longitudinal axis of the device or be situated substantially in the shape of a cone, which can be convergent or divergent towards the bottom of the container.

In one example of the invention, the limiting element includes one end positioned opposite the deformable portion and/or in contact therewith, without constraining it substantially. That is to say, the limiting element does not produce any reduction in performance of the wiping member owing to constraints exerted by the limiting element on the deformable portion. In one embodiment, the limiting element does not come into contact with the deformable portion when the adjustment member is in place and at rest. At rest means that the deformable portion is undeformed by movement of the applicator.

The application element can comprise a brush, and the product is typically intended, for example, to be applied on the eyelashes and/or the eyebrows. The application element can have, over at least one portion of its length, a non-circular cross-section. Circular cross-sections are also possible.

In one example, the application element includes a core, which is off-center and/or makes an angle with the longitudinal axis of the rod.

The application element can be hollowed out internally and be elastically deformable. In other examples, the application element is solid. Further, the application element can include an inelastic material.

By way of example, the application element can also be configured for application on the lips or the skin, in particular the eyelids.

Another object of the invention is to provide a method of applying make-up with a device as defined above, in which the keratinous materials are made up a first time with the adjustment member in a first position and then a second time with the adjustment member in a second position, different from the first. For example, when the adjustment member is separable from the container, the adjustment member along with the gripping member and applicator can be separated from the container, the keratinous materials treated with the applicator, and then the adjustment member and the gripping member replaced on the container. Next, the applicator can be separated from the container, leaving the adjustment member in the container and a new treatment of the keratinous materials carried out.

As should be apparent, the invention can provide a number of advantageous features and benefits. It is to be understood that, in practicing the invention, an embodiment can be constructed to include one or more features or benefits of embodiments, disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

FIG. 4 is a partial longitudinal section of one example of the container and the wiping member;

FIG. 5 is a view similar to FIG. 4 with the adjustment member in place on the container;

FIG. 6 depicts one example of the wiping member in isolation, in a front view;

FIG. 9 depicts in axial section a variant embodiment of the wiping member;

FIG. 10 is a top view of the wiping member of FIG. 9;

DETAILED DESCRIPTION OF THE PREFERRED EMBODIMENTS

Figure 1:
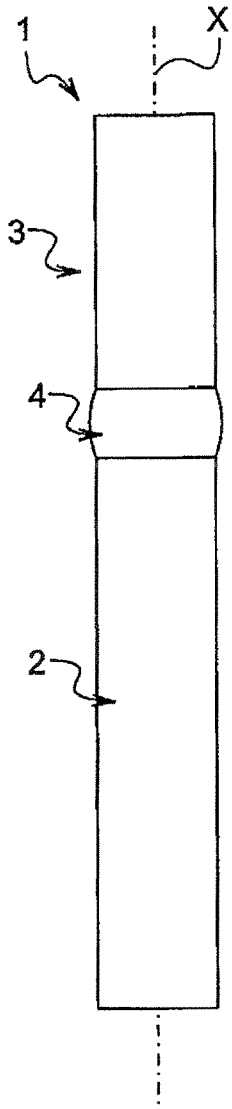
FIG. 1 depicts in elevation a packaging and application device according to one example of the invention.

Referring now to the drawings, wherein like reference numerals are used to designate identical or corresponding parts throughout the several views.

FIG. 1 depicts one example of a packaging and application device comprising a container 2 with longitudinal axis X and an applicator 3 capable of being separated from the container 2. The device 1 comprises a removable adjustment member 4, which allows fixing of the applicator 3 on the container 2. The applicator 3 includes a rod 7 which is connected at one end to a gripping member 8 and at the other end to an application element 10, which is, for example, a mascara brush.

In the example shown in FIG. 1, the container 2 includes a neck 11, threaded externally, and the adjustment member 4 includes, as can be seen in FIG. 5, a mounting skirt 13, threaded internally, arranged to be screwed onto the neck 11. The adjustment member 4 also includes an externally threaded neck 14, onto which an internally threaded mounting skirt 15 of the gripping member 8 can be screwed.

The adjustment member 4 comprises one example of a limiting element 18, typically tubular in shape, which is connected at the top to a transverse wall 19 joining the mounting skirt 13 and the neck 14.

In variants, not illustrated, the adjustment member 4 can include other means of removably fixing on the container 2 and the gripping member 8. For example, raised parts arranged to latch on the container or the gripping member can be provided. Fixing can then take place by friction.

In the example shown in FIG. 4, the container 2 houses a wiping member 20 which can have a tubular body 21 provided at its upper end with a rim 22 resting on the upper end 24 of the neck 11. In the example illustrated, the wiping member 20 also comprises an upwardly inclined flange 26, which is configured to be able to go through the neck 11 during its mounting, and which is applied on a shoulder 30 at the base of the neck 11. Thus, the flange 26 can pass downward through the neck 11 and snap into position in contact with the shoulder 30.

In the example illustrated, the wiping member 20 includes an annular projection 32 that comes to latch in a groove 33 provided on the radially internal surface of the neck 11.

The wiping member 20 comprises a deformable portion 36 which, in the example shown in FIG. 6, comprises a plurality of fins 38 extending radially inwards and defining an opening 40 for passage of the rod 7 and the application element 10. The fins 38 are typically separated by radial slots 39.

Figure 2:
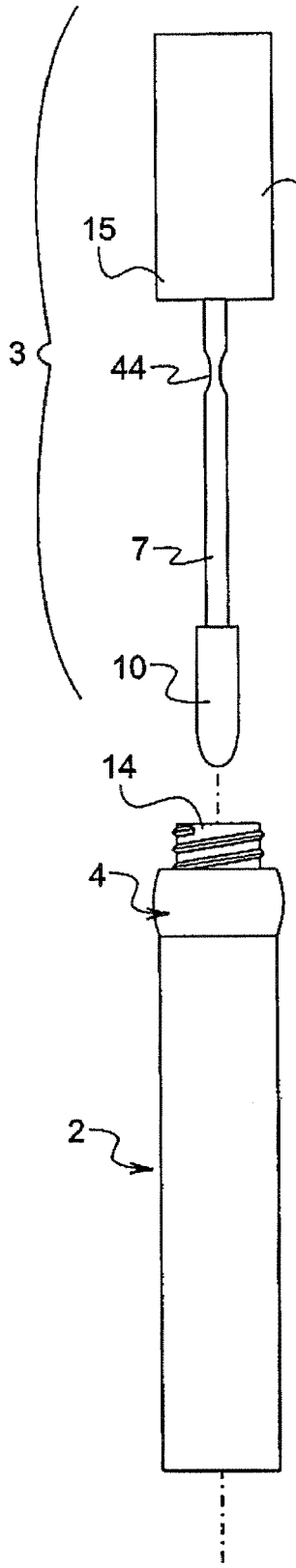
FIG. 2 depicts the device of FIG. 1 when the applicator is separated from the container and the adjustment member left on the container.

The diameter D of the largest capable circle passing through the tip of the fins 38 is, for example, slightly smaller than the diameter of the rod 7. The rod 7 advantageously has, as can be seen in FIG. 2, an annular throat 44 that typically takes up a position adjacent to the fins 38 when the device 1 is closed so that the fins 38 are not constrained by the rod 7 during storage. In other words, the annular throat 44 accommodates the wiping member 20 so as to maintain the wiping member's flexibility. The minimum diameter of the rod 7 at the throat is, for example, 2.5 mm, and the diameter of the rod 7 apart from the throat is, for example, 4 mm.

When the adjustment member 4 is in place on the neck 11, the lower end of the limiting element 18 takes up a position in proximity to or in contact with the deformable portion 36. Preferably, the limiting element is positioned without constraining the fins 38 so much that the deformable portion 36 loses its ability to deform.

Figure 3:
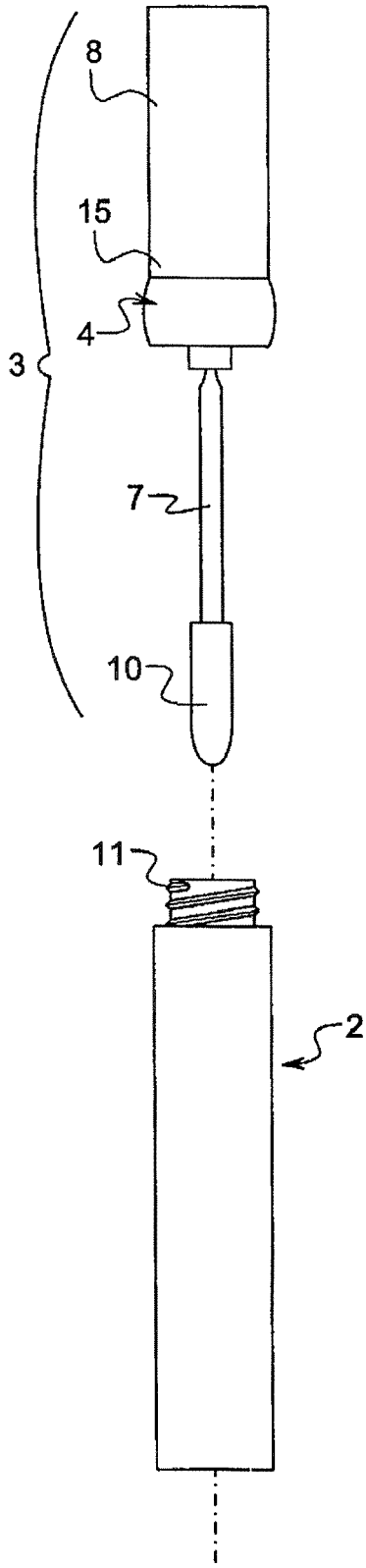
FIG. 3 is a view similar to FIG. 2, but the adjustment member is left on the applicator when the applicator is separated from the container.
Figure 7:
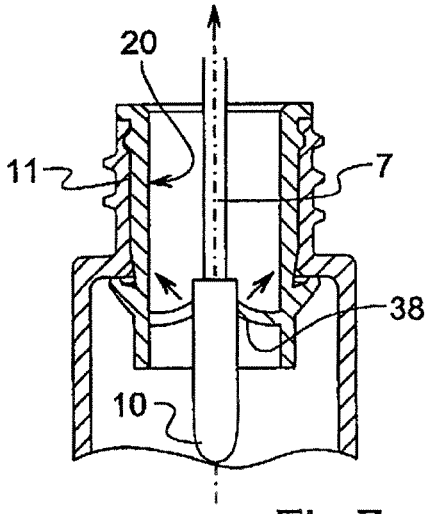
FIG. 7 illustrates deformation of an example of the deformable portion of the wiping member in the absence of an adjustment member.

One example of use a device is discussed below. The user can unscrew the applicator 3 leaving the adjustment member 4 either on the container 2 as depicted in FIG. 2, or on the applicator 3 as illustrated in FIG. 3, depending on whether the user desires a more intensive or less intensive wiping of the application element 10. In the absence of the adjustment member 4, the fins 38 can, as illustrated in FIG. 7, bend freely upwards to a great extent upon passage of the application element 10. Typically, the more freely the fins 38 can bend upwards, the less the fins 38 will wipe the application element. Therefore, the application element will be more laden with product.

Figure 8:
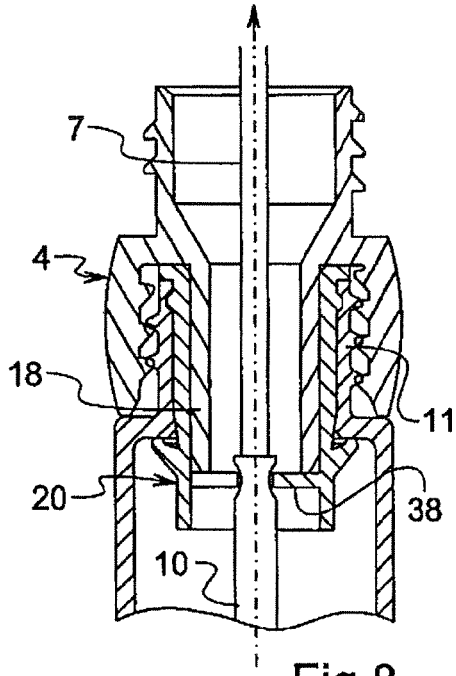
FIG. 8 illustrates an example of the wiping member in the process of wiping the application element when the adjustment member is present on the container.

When the adjustment member 4 is present on the container 2, as illustrated in FIG. 8, the limiting element 18 opposes the upwards deformation of the fins 38 upon passage of the application element 10 so that the application element 10 is more strongly wiped and less laden with product.

In another example of the invention, the wiping member 20 can be implemented differently and the opening 40 for passage of the rod 7 and the application element 10 can also be defined by a corrugated lip 60 as illustrated in FIGS. 9 and 10. The lip 60 can include, for example, several corrugations 61 in the circumferential direction. The corrugations 61 of the wiping member 20 can vary in amplitude and number.

The wiping member 20 can, for example, comprise between 2 and 12, preferably between 4 and 10, corrugations 61. They can be distributed regularly or irregularly. They can all have the same amplitude. Alternatively, the corrugations 61 can have different amplitudes or shapes or in a variant be different. Two adjacent corrugations can have different profiles, if desired.

In one preferred embodiment, the free edge 62 of the wiping lip does not extend entirely in one plane, in the absence of constraints. For example, the wiping lip 60 can extend in a median plane substantially perpendicular to the longitudinal axis of the device or extend generally in a cone, either convergent in the direction of the bottom of the container as illustrated in FIG. 9, or in the direction of the output of the container. The wiping lip 60 can have a constant thickness or, in a variant, a variable thickness. The wiping lip can, for example, be thinner at a point close to its free edge 62 and thicker at a point further away from its free edge. The wiping lip 60 can have, in the circumferential direction, at a given distance from the longitudinal axis X of the device, a substantially constant thickness, for example varying by less than 10% over a complete revolution. On the other hand, this thickness can vary as measured in a direction closer to or farther from the longitudinal axis X. Thus, the thickness of the wiping lip can be, for example, between 0.1 and 0.8 mm. It can be, for example, approximately 0.2 mm at the free edge and approximately 0.5 mm at a point on the wiping lip further away from the free edge 62, for example at the periphery of the wiping lip.

The wiping lip 60 can spread when pushed by the application element 10 before stretching elastically. During the spreading of the wiping lip 60, the corrugations 61 typically have a tendency to level out, the wiping lip being observed from the center of the opening 40 defined by it.

In one preferred embodiment, opening 40 of the wiping member can be configured to have an ability to change from a reduced diameter allowing wiping of the rod 7 to change to a larger diameter allowing wiping of the application element 10 without necessarily requiring a large elongation of the material of the wiping lip. Some examples of structure providing this ability include forming slots, corrugations, or separate fins in the wiping member.

When the adjustment member 4 is in place, the limiting element 18 typically does not press or presses very little on the lip 60, so that the lip 60 can retain consistent wiping characteristics over time.

Figure 13:
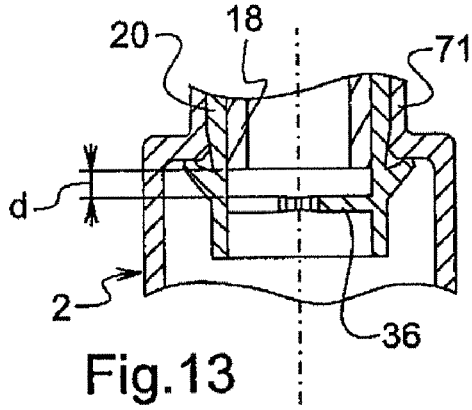
FIG. 13 is a partial longitudinal section of the device of FIG. 11.
Figure 11:
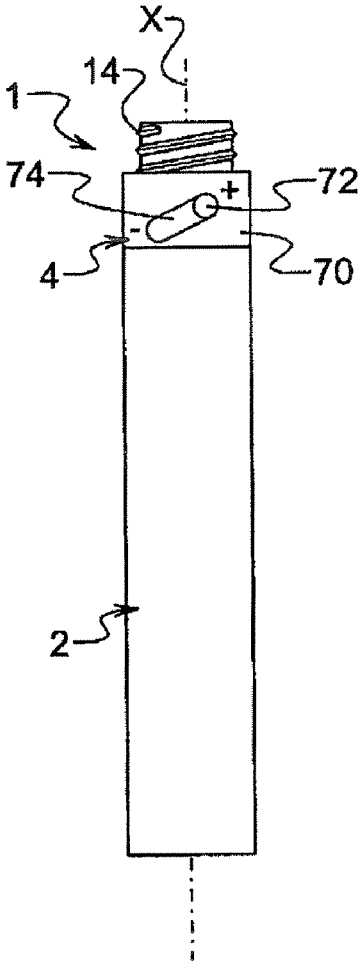
FIGS. 11 and 12 depict in elevation alternate embodiments of the device according to the invention, for two positions of the adjustment member.
Figure 12:
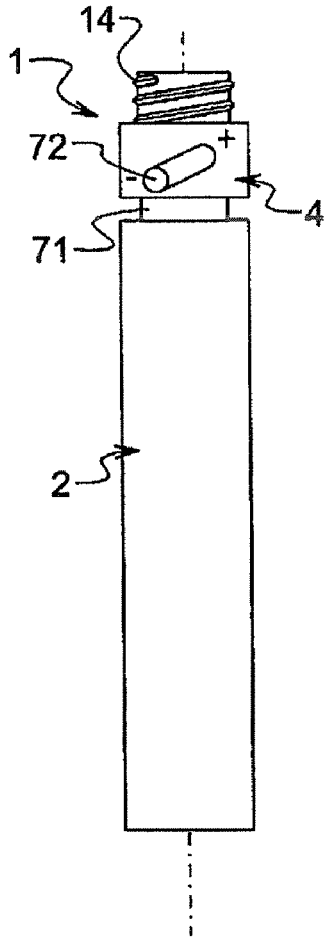

FIGS. 11 to 13 depict a device 1 according to a variant embodiment of the invention in which the adjustment member 4 is mounted permanently on the container 2. The adjustment member 4 comprises a threaded neck 14 allowing fixing of the gripping member 8 of the applicator 3.

In the example shown in FIGS. 11 and 12, the adjustment member 4 is mounted on the container 2 so as to move axially when driven rotationally.

The adjustment member 4 comprises, for example, a skirt 70, which replaces the internally threaded skirt 13 of the example of FIG. 5 and which can turn about an upper portion 71 of the container 2, provided with at least one raised part 72 such as, for example, a pin. This raised part 72 can be engaged in a slot 74 in the skirt 70 and can move therein so that a rotation of the adjustment member 4 is accompanied by its movement along the axis X.

In the example illustrated, the raised part 72 is visible through the slot 74 and can serve as an adjustment indicator. In other examples, the raised part 72 is not visible.

In a variant not illustrated, the raised part or parts of the container serving to hold the adjustment member can be inconspicuous and the container and adjustment member can comprise indications informing the user of the position taken by the adjustment member.

Depending on the angular position of the adjustment member 4, the limiting element 18 can move closer to or further away from the deformable portion 36 of the wiping member 20. As illustrated in FIG. 13, the distance d between the two can be, for example, substantially zero when the adjustment member 4 is in the position of FIG. 11, corresponding to intensive wiping, and maximum when the adjustment member 4 is in the position of FIG. 12, corresponding to less strong wiping. The adjustment member 4 can also be implemented differently and extend, for example, substantially over the entire length of the container.

In the examples illustrated, it is the limiting element 18 that moves in relation to the container 2. In a variant not illustrated, the limiting element is fixed in relation to the container and it is the wiping member that moves axially in relation to the limiting element and the container 2, in this case being attached to an adjustment member which makes it possible to perform this movement.

Figure 17:
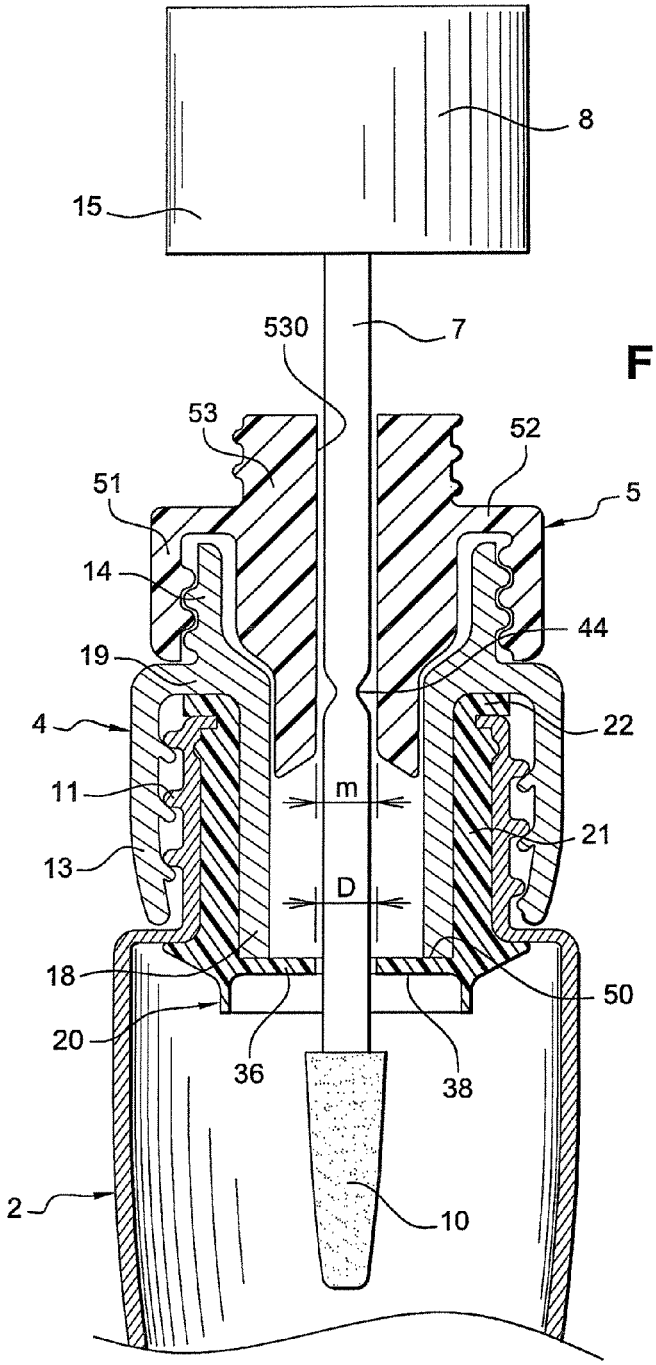
FIG. 17 is a view in partial longitudinal section of a variant embodiment of the device according to the invention.

According to another example of the invention depicted in FIG. 17, the adjustment member 4 can be surmounted by a wiping ring 5. The wiping ring includes in this example a sleeve 51, a radial flange 52, and a shaft 53. The sleeve 51 can be lined internally with a thread adapted to cooperate with the threaded neck 14 of the adjustment member 4. In the final mounted position of the wiping ring 5 on the adjustment member 4, the radial flange 52 can come into abutment on the neck 14.

The shaft 53 can include a part extending into the limiting element 18 and a part projecting radially outwards (towards the outside). In this example, the part projecting towards the outside can include an external thread adapted to provide fixing by screwing of the gripping member 8.

This shaft 53 defines internally a channel 530. The channel 530 can have a circular-shaped cross-section. Such a channel comprises a diameter m which is, for example, substantially equal to the diameter D defined by the deformable portion of the wiping member, or perhaps smaller or larger. When the channel 530 is present, the application element 10 can undergo a double wiping. Such a wiping ring 5 thus makes it possible to further reduce the product load on the application element 10 which provides finer make-up.

Figure 14:
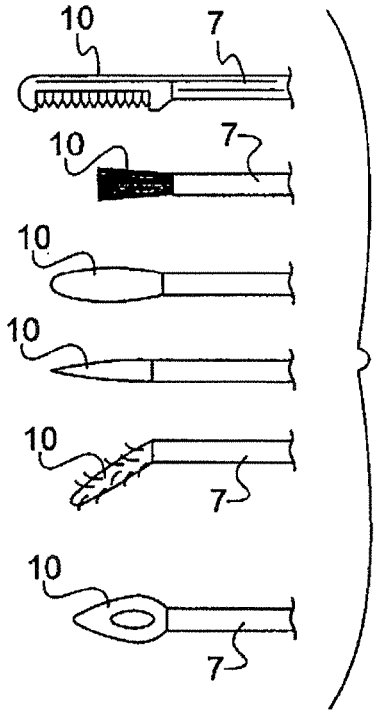
FIG. 14 depicts various examples of application elements.

The invention is not limited to one particular type of application element and the application element 10 can be, for example, other than a mascara brush. For example, the application element can be a comb, an end fitting, flocked or not, made from elastomer, a felt pad, foam material or a hair pencil, or else a hollowed out application element, deformable or not upon passing the wiping member, as illustrated in FIG. 14.

The largest transverse dimension of the application element 10 can be smaller than or larger than the diameter of the rod 7.

Figure 15:
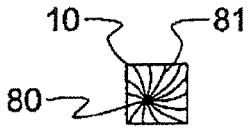
FIG. 15 depicts in schematic cross-section an application element variant.

The application element can be a brush including a core 80 and hairs 81 extending from the core, with an outer surface having an overall cylindrical shape generated by revolution about the axis of the core, or with a non-circular section, as illustrated in FIG. 15. The core 80 can be centered within the cross-section or off-center, as illustrated in FIG. 15.

Figure 16:
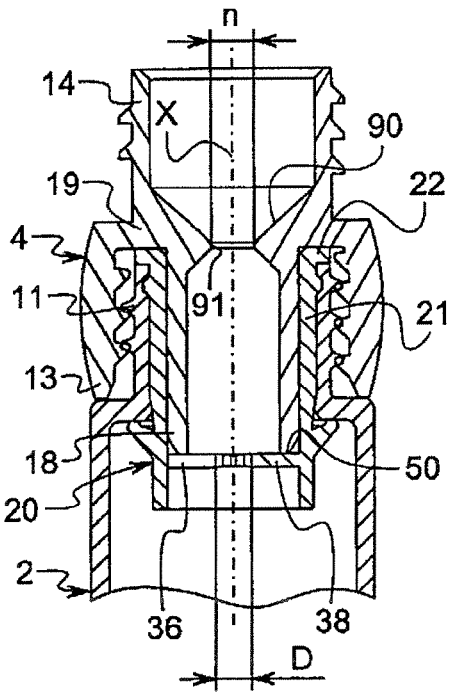
FIG. 16 is a view similar to FIG. 5 of a variant embodiment of the adjustment member.

The adjustment member 4 can be implemented with at least one wiping lip 90 as illustrated in FIG. 16, which can define a passage area for the application element which is, for example, larger than, smaller than or equal to that defined by the wiping member 20.

The lip 90 has, for example, a circular-shaped free edge 91 centered on the axis X and with a diameter n which is, for example, substantially equal to the diameter D defined by the deformable portion of the wiping member, or perhaps smaller or larger. In the presence of the wiping lip 90, the application element 10 can undergo a double wiping. It is also possible to provide an adjustment member 4 with such a lip 90 surmounted by a wiping ring 5 (not depicted). In this case, the diameter m can be provided equal to, smaller than or larger than the diameter n. With such an arrangement, the application element 10 can thus undergo a triple wiping.

In variants, not illustrated, the limiting element 18 has an internal diameter which is, for example, substantially equal to that of the wiping member 20 or which can also be smaller.

The wiping member can be implemented in at least one of the materials in the following list: elastomer, vulcanised or not, silicone, nitrile, butyl, EPDM, thermoplastic elastomer, SIS, SEAS, Hytrel®, Pebax®, PE, PP, PET, PA, PVC, PS. However, the wiping member can be implemented using other materials. The wiping member can be flocked, if desired.

Throughout the description and claims, expressions such as "including one," "having one," "has one," or "comprises one" should be regarded as synonymous with "including at least one," unless otherwise specified.

Numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and application of a cosmetic, comprising:

a container containing a product;

an applicator including a rod connected at a first end to a gripping member and connected at a second end, opposite the first end, to an application element;

a first wiping member disposed in the container and including a deformable portion configured to wipe the application element during extraction of the application element from the container; and an adjustment member, movable in relation to the first wiping member between at least first and second positions and arranged proximate to the deformable portion of the first wiping member in the first position such that deformation of the deformable portion is limited by the adjustment member during passage of the application element through the deformable portion, deformation of the deformable portion is less limited by the adjustment member when the adjustment member is in the second position than when the adjustment member is in the first position, and the adjustment member limits deformation of the deformable portion without substantially constraining the deformable portion when the deformable portion is un-deformed by either the application element or rod, irrespective of a position of the adjustment member.

2. The device according to claim 1, wherein deformation of the deformable portion is not limited by the adjustment member when the adjustment member is in the second position.

3. The device according to claim 1, wherein the deformable portion is configured to deform without stretching circumferentially during passage of the application element.

4. The device according to claim 1, wherein the deformable portion is configured to deflect in a direction parallel to a longitudinal axis of the container during passage through it of the application element.

5. The device according to claim 1, wherein the adjustment member includes a limiting element configured to be positioned in proximity to or in contact with the deformable portion so as to limit the deformation of the deformable portion during passage through the deform able portion of the application element.

6. The device according to claim 1, wherein the adjustment member is configured to be coupled to the container in a removable manner.

7. The device according to claim 6, wherein the adjustment member is configured to be coupled, in a removable manner, to the gripping member.

8. The device according to claim 7, wherein the adjustment member includes an internally threaded mounting skirt configured to be threaded onto the container; and an externally threaded neck configured to thread into the gripping member.

9. The device according to claim 1, wherein the rod includes a throat located in a position adjacent to the deformable portion when the applicator is in place on the adjustment member and the deformable portion is fixed on the container.

10. The device according to claim 1, wherein the adjustment member is coupled permanently to the container while being movable axially and rotationally in relation to the container.

11. The device according to claim 10, wherein the adjustment member includes a slot, into which extends a raised part attached to the container, and the slot is inclined so as to convert a rotational movement of the adjustment member relative to the container into an axial movement relative to the container.

12. The device according to claim 1, wherein the deformable portion includes at least one wiper slot.

13. The device according to claim 1, wherein the deformable portion includes a plurality of fins.

14. The device according to claim 1, wherein the deformable portion includes a corrugated lip.

15. The device according to claim 1, wherein the application element includes a brush.

16. The device according to claim 1, wherein the adjustment member includes a cross-section through which the application element passes, and the cross-section is larger than an opening defined by the first wiping member.

17. The device according to claim 16, wherein an internal diameter of the cross-section is larger than an internal diameter of the first wiping member.

18. The device according to claim 1, wherein the adjustment member includes a cross-section provided for passage of the application element, and the cross-section is smaller than an opening defined by the first wiping member.

19. The device according to claim 18, wherein the cross-section has an internal diameter smaller than an internal diameter of the opening defined by first wiping member.

20. The device according to claim 1, wherein the application element deforms the deformable portion of the first wiping member during passage through the deformable portion.

21. The device according to claim 20, wherein the deformable portion is configured to increase a size of a passage area without stretching as the application element passes through the passage area.

22. The device according to claim 1, wherein the deformable portion defines a passage area for the application element with a diameter smaller than a diameter of the rod.

23. The device according to claim 1, wherein the deformable portion defines a passage area for the application element with a diameter at least as large as a diameter of a throat of the rod.

24. The device according to claim 1, wherein the deformable portion is funnel-shaped with respect to a longitudinal axis of the container.

25. The device according to claim 24, wherein a largest opening of the deformable portion is closer to the first end of the rod than a smallest opening of the deformable portion when the applicator is inside the container.

26. The device according to claim 1, wherein the application element includes a non-circular cross-section.

27. The device according to claim 1, wherein the application element extends along a longitudinal axis which is off-center in relation to a longitudinal axis of the rod.

28. The device according to claim 1, wherein the application element extends along a longitudinal axis forming a non-zero angle with a longitudinal axis of the rod.

29. The device according to claim 1, wherein the application element is hollow.

30. The device according to claim 29, wherein the application element is configured to deform during passage through the first wiping member.

31. The device according to claim 1, wherein the first wiping member is the only component in the device configured to wipe the application element.

32. The device according to claim 1 further comprising a second wiping member.

33. The device according to claim 32, wherein the second wiping member includes the adjustment member, and the adjustment member includes a wiping lip.

34. The device according to claim 33, wherein the wiping lip includes a circular free edge and the deformable portion defines an opening with a diameter smaller than or equal to an inside diameter of the wiping lip.

35. The device according to claim 34, wherein the second wiping member includes a wiping ring mounted on the adjustment member.

36. The device according to claim 35, wherein the wiping ring includes an internal channel with a diameter smaller than or equal to an inner diameter of the deformable portion.

37. The device according to claim 1, wherein the product is configured to be applied on at least one of eyelashes and eyebrows.

38. The device according to claim 1, wherein the product is configured to be applied on at least one of a lip of a user and skin of a user.

39. The device according to claim 38, wherein the product is configured to be applied on eyelids of a user.

40. A device for packaging and application of a cosmetic, comprising:

a container containing a product;

an applicator including a rod connected at a first end to a gripping member and connected at a second end, opposite the first end, to an application element;

a wiping member disposed in the container and including a deformable portion configured to wipe the application element during extraction of the application element from the container; and means for adjusting amounts of deformation of the deformable portion, movable in relation to the wiping member between at least first and second positions and arranged proximate to the deformable portion of the wiping member in the first position such that deformation of the deformable portion is limited by the means for adjusting during passage of the application element through the deformable portion, deformation of the deformable portion is less limited by the means for adjusting when the means for adjusting is in the second position than when the means for adjusting is in the first position, and the means for adjusting limits deformation of the deformable portion without substantially constraining the deformable portion when the deformable portion is un-deformed by either the application element or rod, irrespective of a position of the means for adjusting.

* * * * *